US010270194B2

(12) United States Patent
Fan et al.

(10) Patent No.: US 10,270,194 B2
(45) Date of Patent: Apr. 23, 2019

(54) ELECTRICAL CONNECTOR ASSEMBLY HAVING A LATCH SECURED TO BOTH CONNECTOR HOUSING AND INTERNAL SUBSTRATE

(71) Applicant: FOXCONN INTERCONNECT TECHNOLOGY LIMITED, Grand Cayman (KY)

(72) Inventors: Xiao Fan, Kunshan (CN); Jun Chen, Kunshan (CN); Jerry Wu, New Taipei, CA (US); Qiu-Ming Wu, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/849,637

(22) Filed: Dec. 20, 2017

(65) Prior Publication Data

US 2018/0175528 A1 Jun. 21, 2018

(30) Foreign Application Priority Data

Dec. 20, 2016 (CN) ..... 2016 2 1406595 U

(51) Int. Cl.

| | |
|---|---|
| ***H01R 12/71*** | (2011.01) |
| ***H01R 13/516*** | (2006.01) |
| ***H01R 13/6594*** | (2011.01) |
| ***H01R 13/6581*** | (2011.01) |
| ***H01R 12/70*** | (2011.01) |
| ***H01R 13/6583*** | (2011.01) |
| *H01R 13/66* | (2006.01) |
| *H01R 31/06* | (2006.01) |

(52) U.S. Cl.

CPC ..... *H01R 12/716* (2013.01); *H01R 12/707* (2013.01); *H01R 12/7058* (2013.01); *H01R 13/516* (2013.01); *H01R 13/6581* (2013.01); *H01R 13/6583* (2013.01); *H01R 13/6594* (2013.01); *H01R 12/712* (2013.01); *H01R 13/6658* (2013.01); *H01R 31/065* (2013.01)

(58) Field of Classification Search

CPC ..... H01R 13/6581; H01R 13/6585; H01R 13/6658

See application file for complete search history.

(56) References Cited

U.S. PATENT DOCUMENTS

| | | | | |
|---|---|---|---|---|
| 7,114,963 | B2 | 10/2006 | Shuey et al. | |
| 9,397,433 | B2 * | 7/2016 | Kao | H01R 13/658 |
| 9,397,442 | B2 | 7/2016 | Sutter et al. | |
| 9,484,676 | B2 | 11/2016 | Chuang | |
| 2012/0309235 | A1 | 12/2012 | Yuan | |
| 2015/0288104 | A1 | 10/2015 | Regnier | |
| 2016/0056583 | A1 * | 2/2016 | Chuang | H01R 13/6581 439/607.01 |

FOREIGN PATENT DOCUMENTS

| | | |
|---|---|---|
| CN | 203850559 | 9/2014 |
| CN | 105261855 | 1/2016 |

* cited by examiner

*Primary Examiner* — Ross N Gushi

(74) *Attorney, Agent, or Firm* — Wei Te Chung; Ming Chieh Chang

(57) ABSTRACT

An electrical connector assembly includes: a connector housing receiving a plurality of contacts mounted to an internal substrate; a shielding shell enclosing the connector housing; and a pair of latches secured to the connector housing in a cantilevered fashion; wherein the latch has an arm secured to the substrate.

19 Claims, 9 Drawing Sheets

ELECTRICAL CONNECTOR ASSEMBLY HAVING A LATCH SECURED TO BOTH CONNECTOR HOUSING AND INTERNAL SUBSTRATE

BACKGROUND OF THE INVENTION

1. Field of the Invention

The present invention relates to an electrical connector assembly having a pair of latches secured to a connector housing in a cantilevered fashion as well as secured to an internal substrate for increased securement.

2. Description of Related Art

China Patent No. 105261855 discloses an electrical connector comprising an insulative housing, an upper and lower rows of contacts arranged in the insulative housing, a shielding shell enclosing the insulative housing, and a pair of latches secured to the insulative housing. U.S. Pat. No. 9,484,676 discloses an electrical connector comprising, among others, a pair of latches each having a pair of soldering feet for guiding and soldering to conduct pads of an internal printed circuit board.

SUMMARY OF THE INVENTION

An electrical connector assembly comprises: a connector housing receiving a plurality of contacts mounted to an internal substrate; a shielding shell enclosing the connector housing; and a pair of latches secured to the connector housing in a cantilevered fashion; wherein the latch has an arm secured to the substrate.

DETAILED DESCRIPTION OF THE PREFERRED EMBODIMENT

Figure 1:
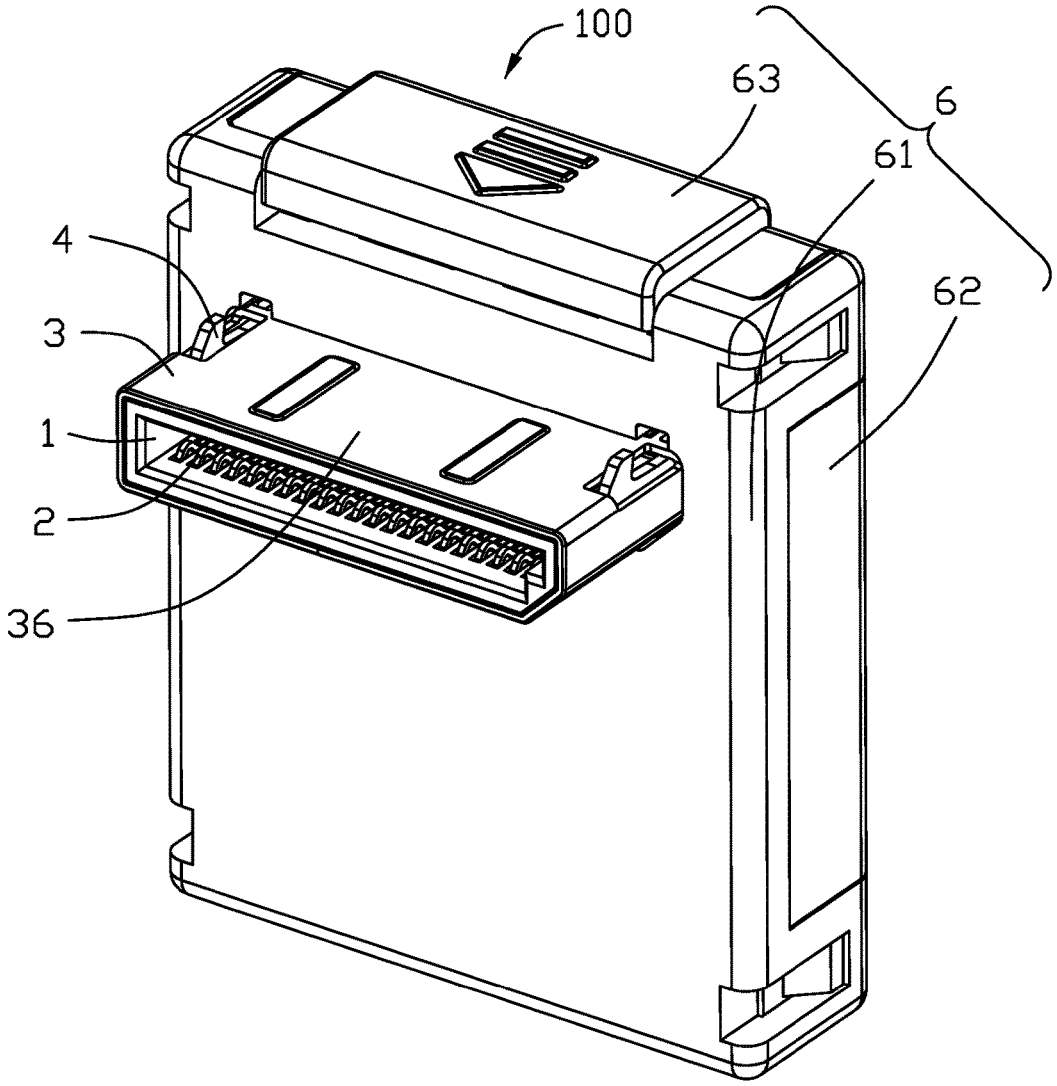
FIG. 1 is a perspective view of an electrical connector assembly in accordance with the present invention.
Figure 2:
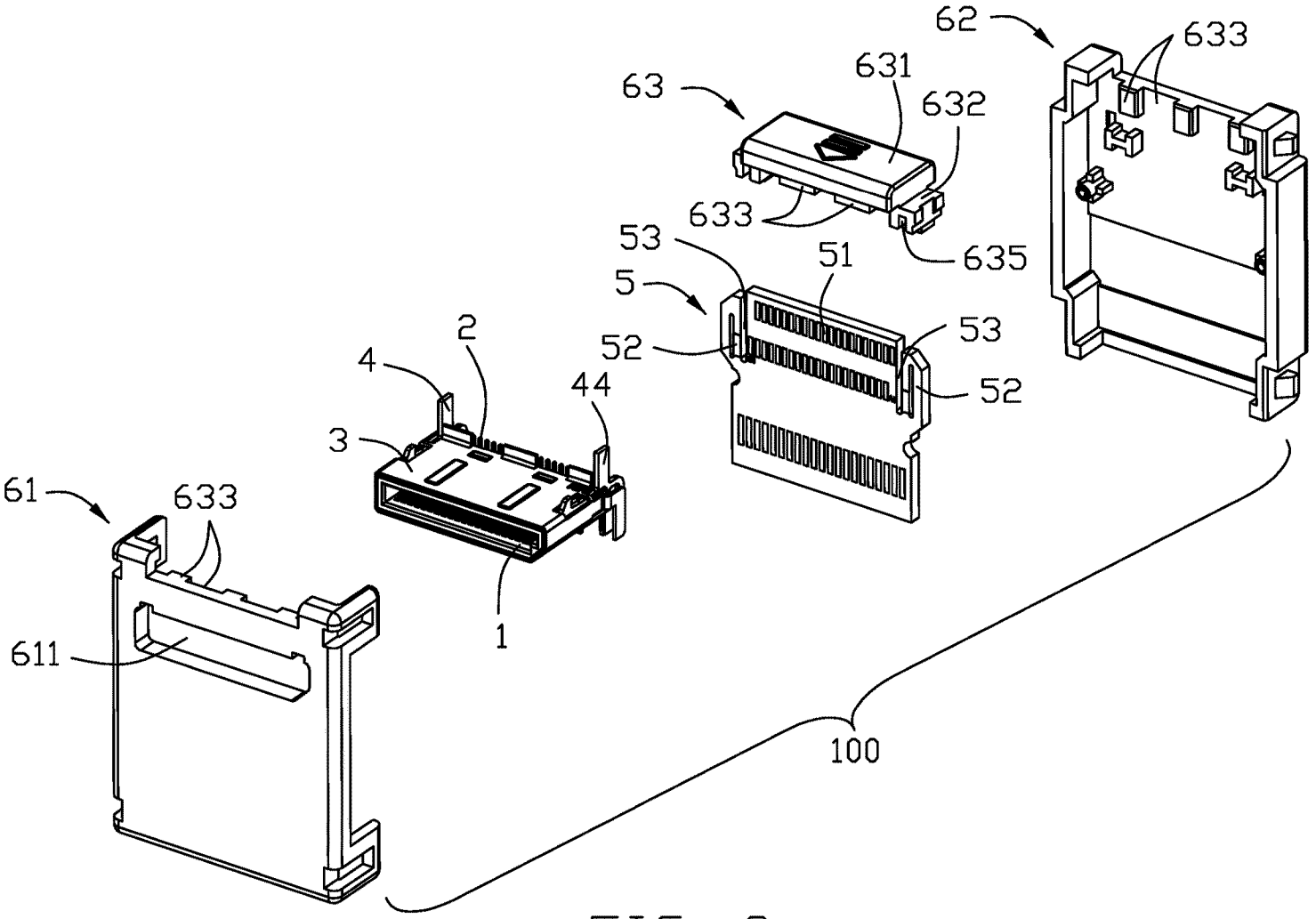
FIG. 2 is an exploded view of the electrical connector assembly.
Figure 3:
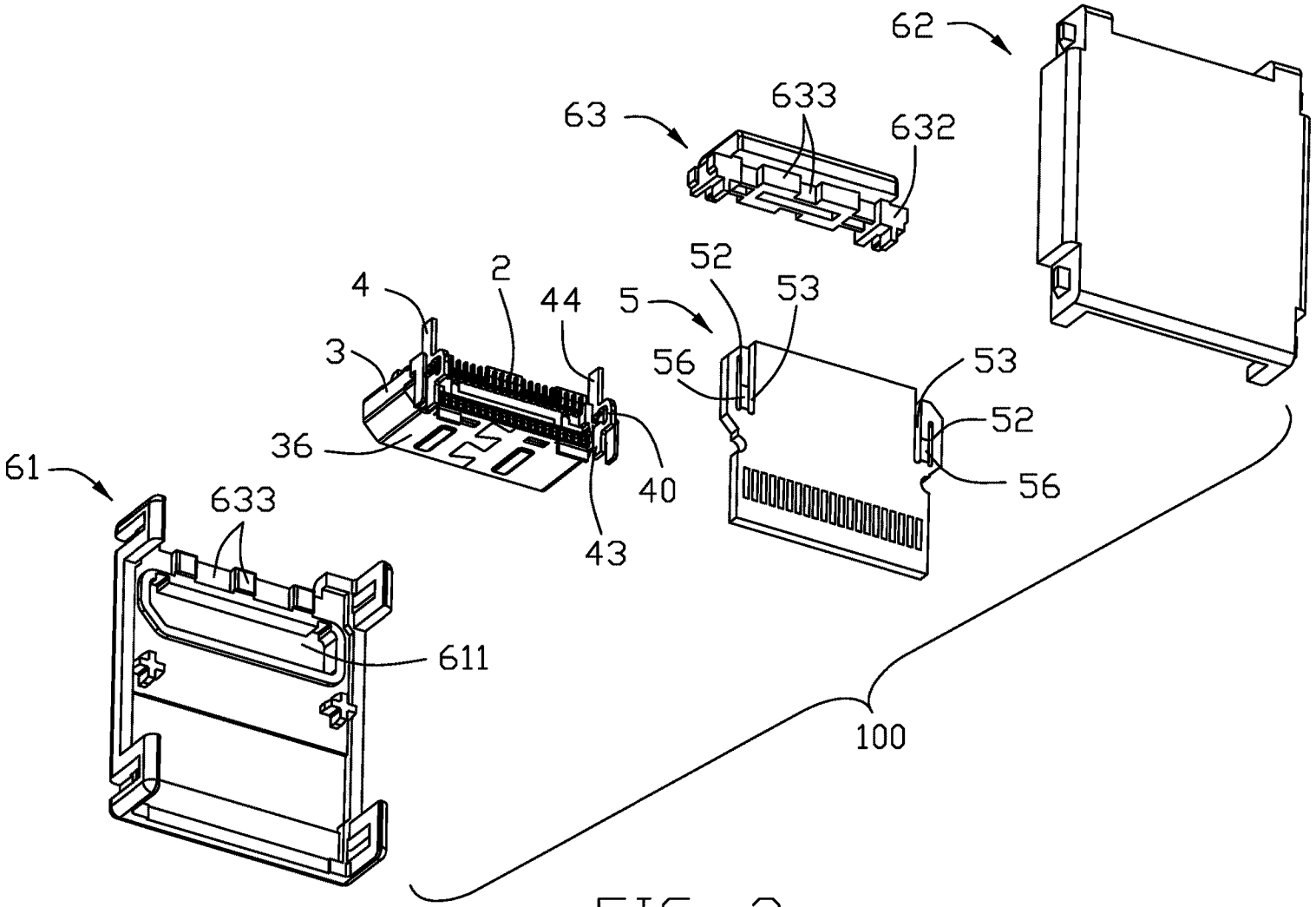
FIG. 3 is a view similar to FIG. 2 but from a different perspective.

Referring to FIGS. 1-5, an electrical connector assembly 100 comprises an insulative housing 1, an internal substrate 5, a plurality of contacts 2 received in the insulative housing 1 and mounted to the substrate 5, a shielding shell 3 enclosing the insulative housing 1, and a pair of latches 4 secured to the connector housing 1 in a cantilevered fashion. The electrical connector assembly 100 may further include a cover 6 enclosing a rear of the shielding shell 3 and the substrate 5.

Figure 4:
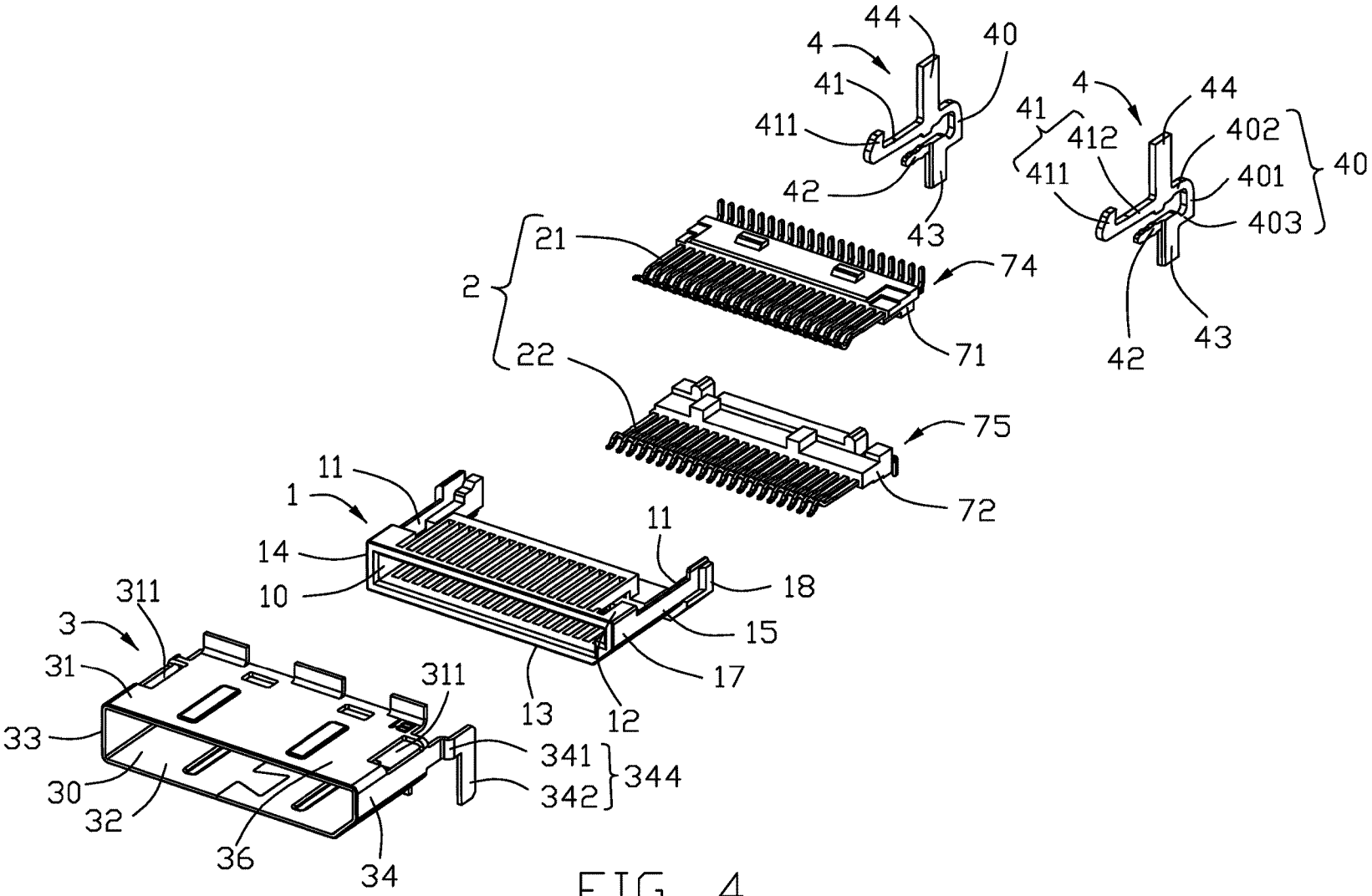
FIG. 4 is an exploded view showing a connector housing, a shielding shell, a pair of contact units, and a pair of latches of the electrical connector assembly.
Figure 5:
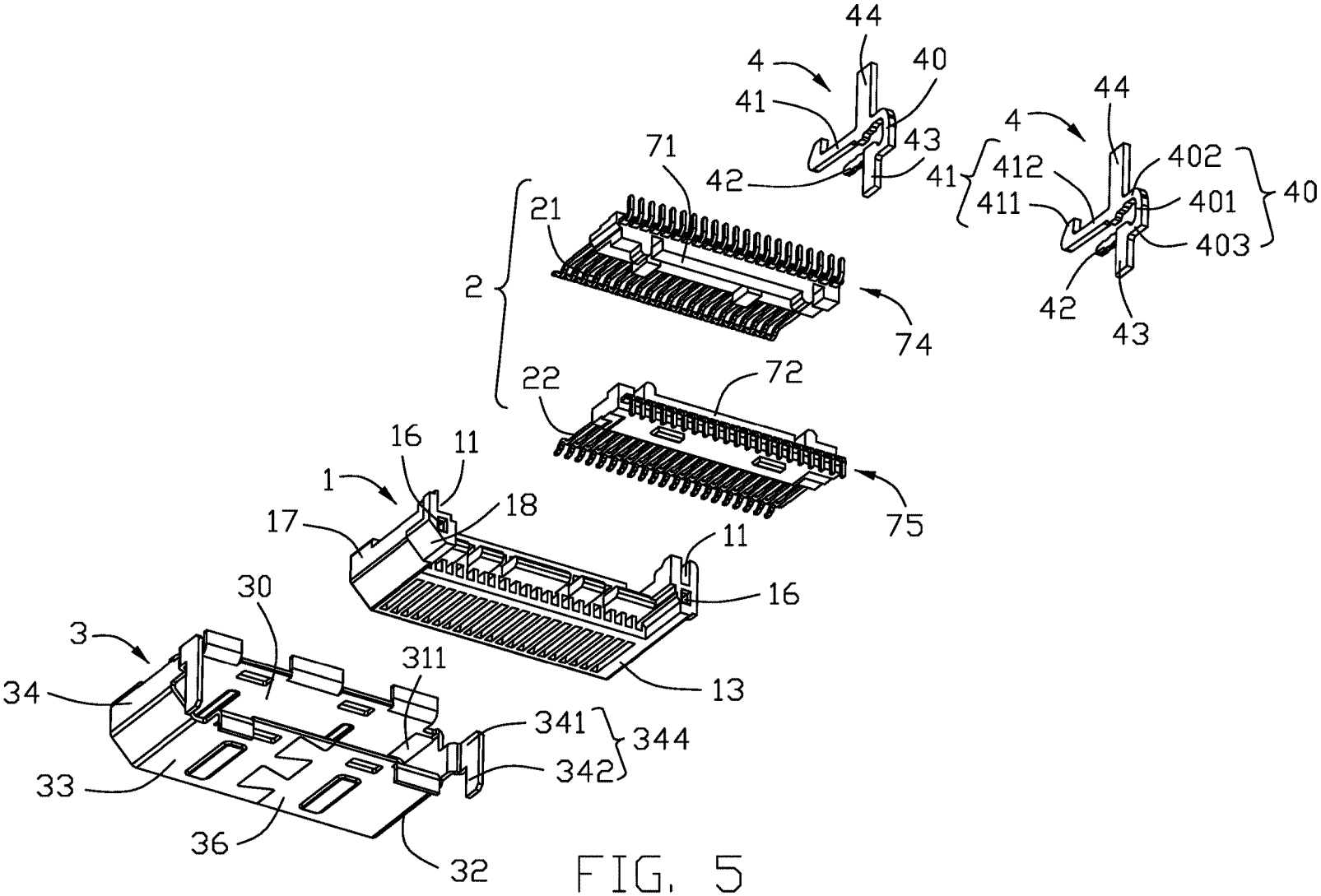
FIG. 5 is a view similar to FIG. 4 but from a different perspective.
Figure 6:
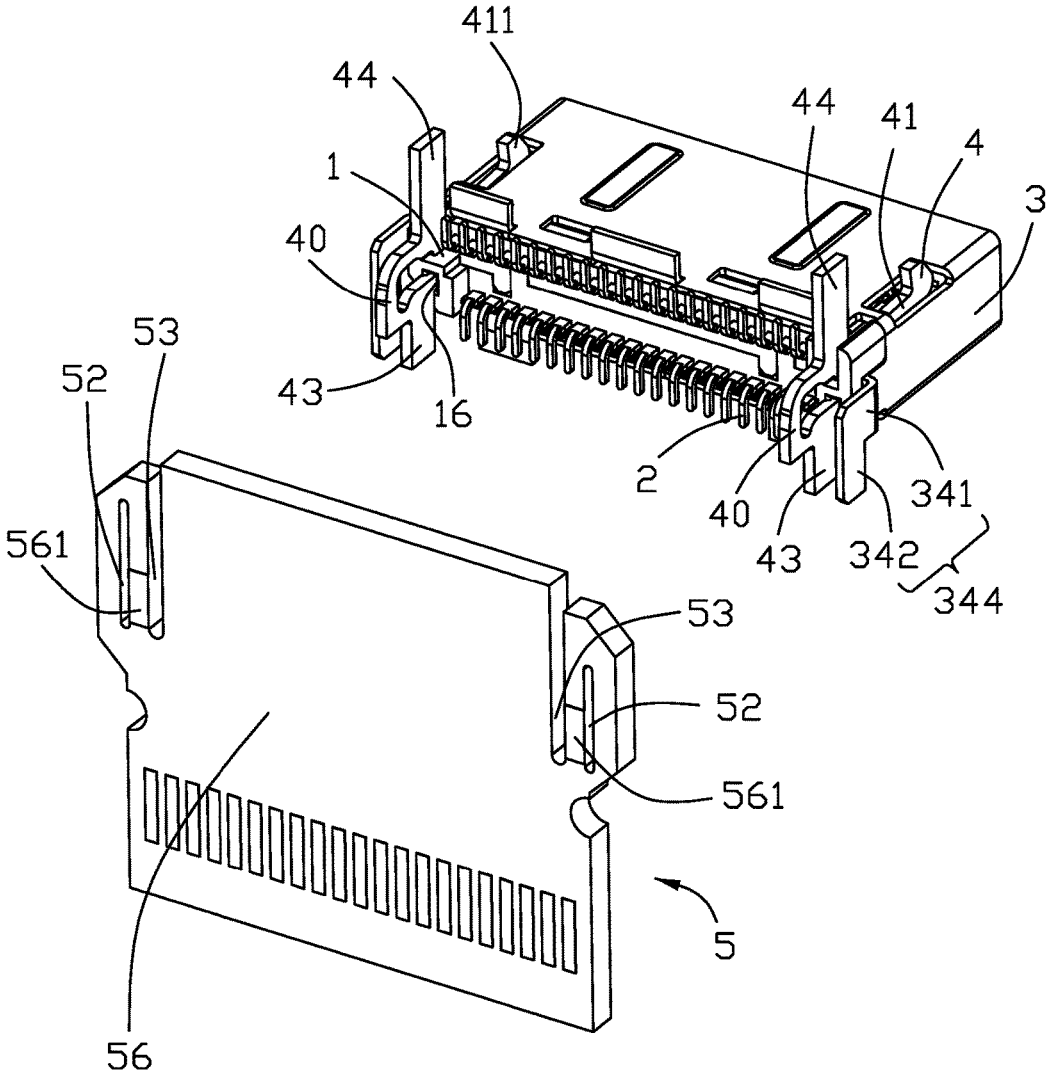
FIG. 6 is an enlarged perspective view of an internal substrate and a combined state of the components in FIG. 4.
Figure 7:
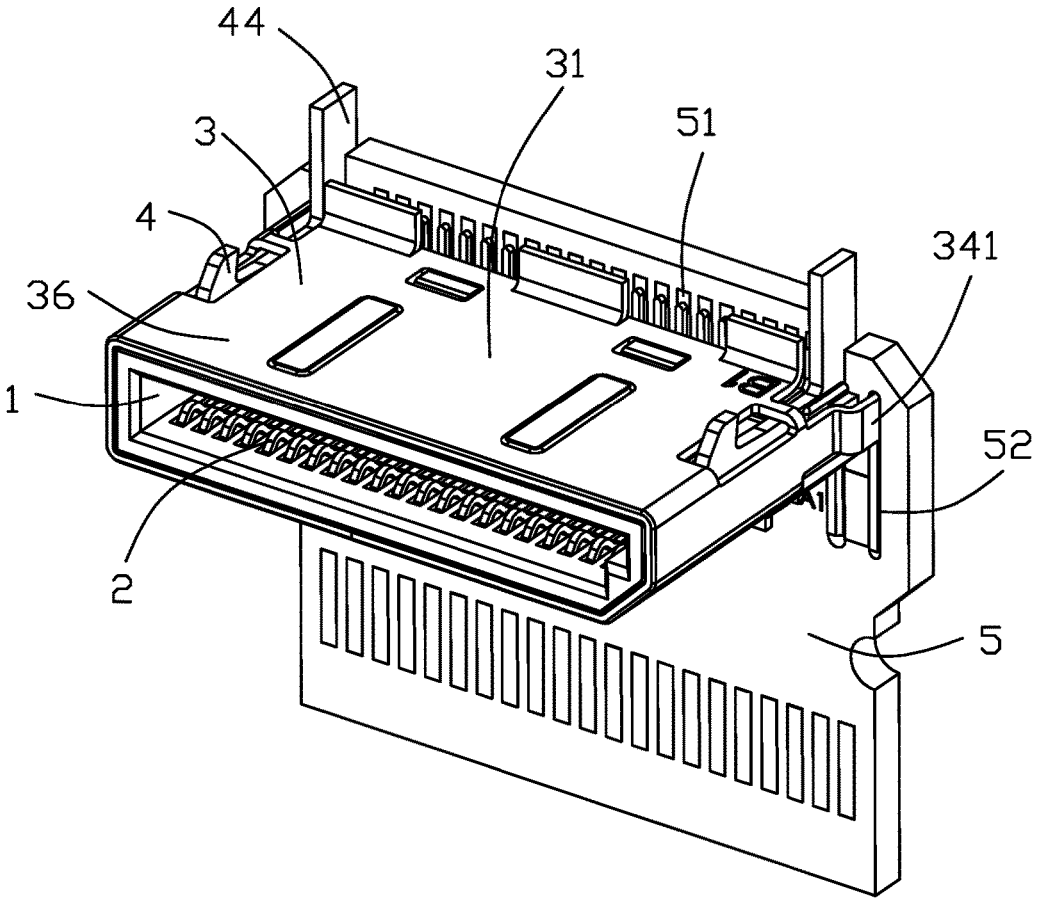
FIG. 7 is a view similar to FIG. 6 but from a different perspective and after the components are mounted to the internal substrate.
Figure 8:
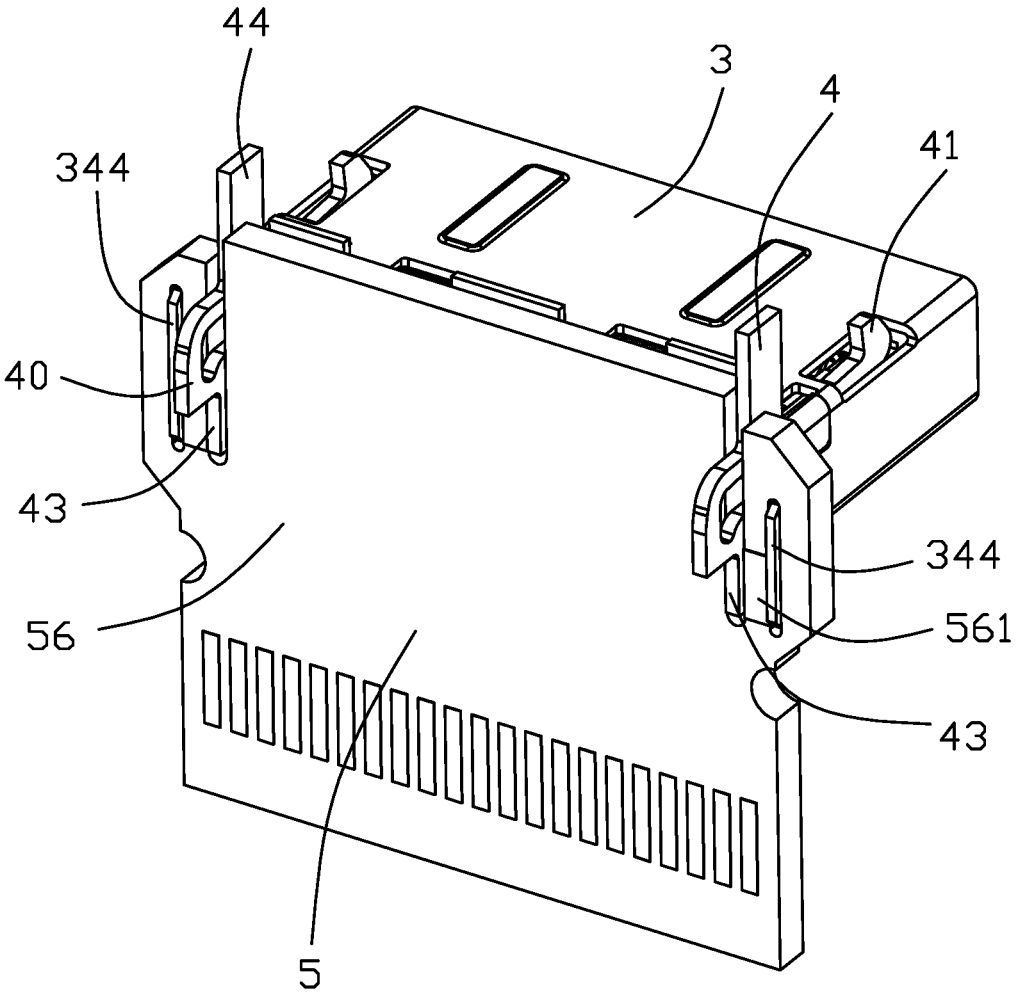
FIG. 8 is a view similar to FIG. 7 but from the perspective of FIG. 6.
Figure 9:
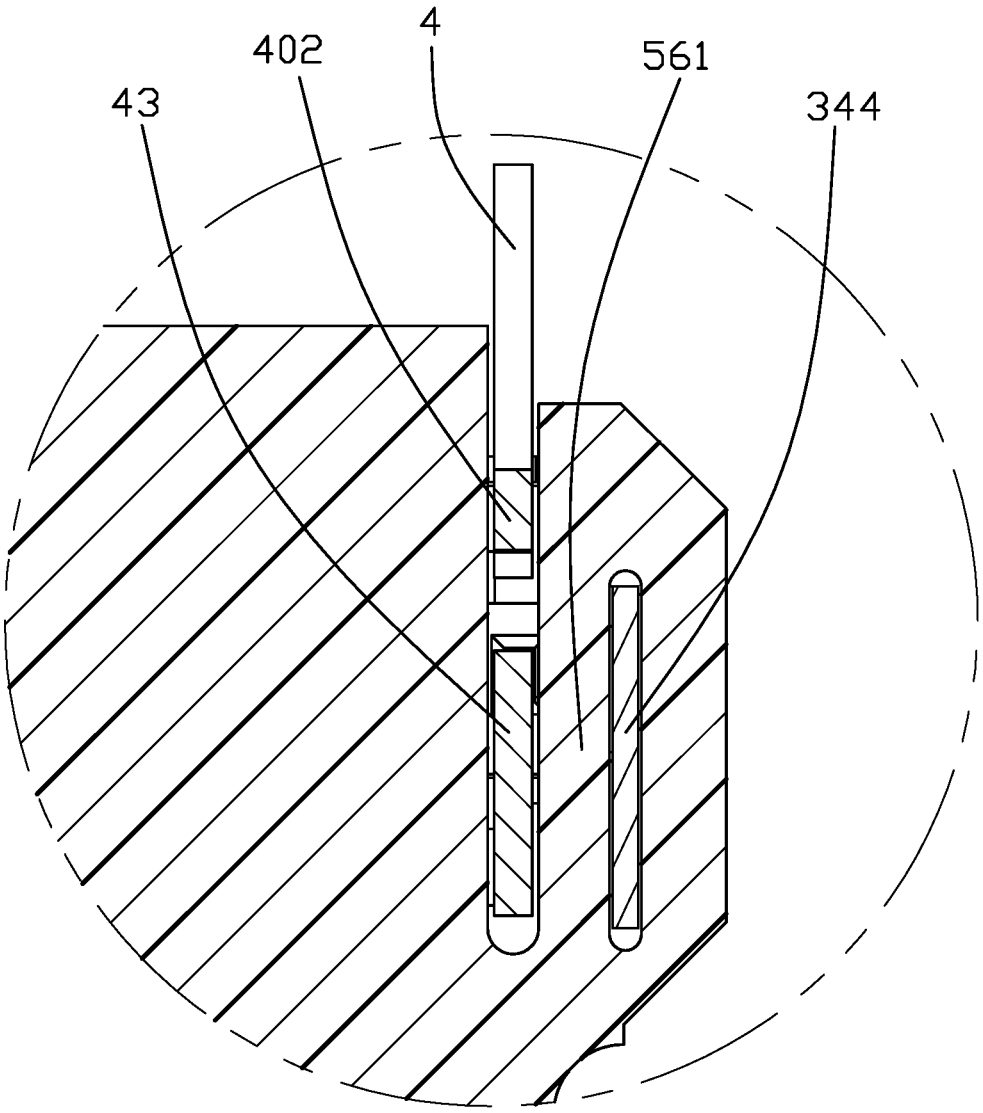
FIG. 9 is an enlarged cross-sectional view of a portion of the electrical connector assembly of FIG. 1 to show the detailed structural relation among the shell and the latch in the slits of the substrate.

Referring specifically to FIGS. 4-5, the plurality of contacts 2 include a row of first contacts 21 and a row of second contacts 22. The first contacts 21 are secured to a first insulator 71 to form a first contact unit 74 and the second contacts 22 are secured to a second insulator 72 to form a second contact unit 75. The first and second contact units 74 and 75 are assembled together first, and then the assembly is mounted to the insulative housing 1. In other applications, the plurality of contacts 2 may also be mounted directly to the insulative housing 1.

The insulative housing 1 has a base 18 and a tongue 17. The tongue 17 has an upper wall 12, a lower wall 13, and a left and right walls 14 and 15 together surrounding a receiving space 10. The insulative housing 1 further has a pair of receiving grooves 11 in the left and right walls 14 and 15 and a pair of receiving holes 16 below the grooves 11.

The latch 4 has a base 40, a latching arm 41, a pressing portion 44, a mounting portion 42, and a securing arm 43. The latching arm 41 has an arm portion 412 and a hook 411. The base 40 is substantially U-shaped, having a middle portion 401 and two end portions 402 and 403. The latching arm 41 extends forward from the upper end portion 402; the pressing portion 44 extends upward from the upper end portion 402. The mounting portion 42 extends forward from the lower end portion 403; the securing arm 43 extends downward from the lower end portion 403. The latching arm 41 is received in the groove 11 of the insulative housing 1; the mounting portion 42 is secured to the hole 16 of the insulative housing 1.

The shielding shell 3 includes a main part 36. The main part 36 has an upper portion 31, a lower portion 32, and a left and right portions 33 and 34 together surrounding a receiving space 30. The shielding shell 3 further include a pair of legs 344 extending rearward from the left and right portions 33 and 34. The leg 344 has a first arm 341 and a second arm 342 angled to each other. The first arms 341 are slightly bent outwardly. The upper portion 31 has a pair of slots 311 for accommodating the hooks 411.

Referring specifically to FIGS. 2-3 and 6-9, the substrate 5 is oriented at a vertical position, i.e., perpendicular to an extending direction of the shielding shell 3. The substrate 5 has plural conductive pads 51 for connecting to the contacts 2, a pair of conductive pads 561 for positioning the shielding shell legs 344, a pair of first slits 53 for receiving the securing arms 43 of the latch 4, and a pair of second slits 52 for receiving the legs 344 of the shielding shell 3. The first slit 53 and the neighboring second slit 52 form a slit unit as a pair. The conductive pad 561 is located between the first and second slits 53 and 52. Preferably, the second arm 342 of the shielding shell leg 344 is leveled with the securing arm 43 of the latch 4. The first slit 53 is opening to outside. In this embodiment, the pressing portion 44 is also partly received in the first slit 53.

Referring again to FIGS. 1-3, the cover 6 enclosing the rear of the shielding shell 3 and the substrate 5 includes a front part 61, a rear part 62, and an upper part 63. The cover upper part 63 has an operating portion 631, a pair of retaining portions 632 for cooperating with the pressing portions 44, and a positioning portion 633 for cooperating with corresponding positioning portions 633 provided on the front and rear parts 61 and 62. A groove 635 is provided on the retaining portion 632. The front part 61 has an opening 611 for the latching arm hook 411 to extend through. When the operating portion 631 is operated by a user as indicated by the arrow sign indicia, the pressing portion 44 together with the latching arm 41 is moved to disengage from a complementary mating connector.

In assembling, referring to FIGS. 1-8, the first contact unit 74, the second contact unit 75, and the pair of latches 4 are respectively mounted to the insulative housing 1. The insulative housing 1 together with the first and second contact units and the latches is then mounted to the shielding shell 3. Next, the substrate 5 is mounted to the rear of the shielding shell 3, with the base 40 and the securing arm 43 of the latch 4 inserting into and/or through the first slit 53 and the leg 344 of the shielding shell 3 inserting at least partly into the second slit 52. Respective rear end faces of the securing arm 43 of the latch 4 and the leg 344 of the shielding shell 3 are exposed rearward to or beyond a rear surface 56 of the substrate 5 and are subsequent soldered to the conductive pad 561 for securing and/or grounding purpose. Lastly, the upper part 63 of the cover 6 is mounted to the pressing portions 44 of the latches 4, the front part 61 of the cover 6 is mounted through the main part 36 of the shielding shell 3 and the rear part 62 of the cover 6 is coupled to the upper and front parts 63 and 61 from a back side.

Referring again to FIGS. 6-8, with provision of the securing arm 43 for securing to the substrate 5 by way of soldering to the conductive pad 561 in addition to the mounting portion 42, the latch 4 is more firmly secured in place to both the insulative housing 1 and the substrate 5. Additionally, provision of the leg 344 of the shielding shell 3 for soldering to the conductive pad 561 further reinforces the firm structure. The feature of the invention is to provide the lengthened first slit 53 and second slit 52 to receive the corresponding lengthened end region sections, i.e., the securing arm 43 of the latch or the leg 344 of the shell 3 in a securing manner wherein the depth of the first slit 53 and that of the second slit 52 along the vertical direction is dimensioned larger than a thickness of the housing 1 in the vertical direction for assuring sufficient securing of the rear end regions of the latch or the shell within the corresponding slit.

What is claimed is:

1. An electrical connector assembly comprising:
a connector housing receiving a plurality of contacts mounted to an internal substrate;
a shielding shell enclosing the connector housing; and
a pair of latches secured to the connector housing in a cantilevered fashion;
wherein
the latch has an arm secured to the substrate; and
the shielding shell includes a leg secured to the substrate.

2. The electrical connector assembly as claimed in claim 1, wherein the latch has a mounting portion located forwardly of the latch arm and secured to the connector housing.

3. The electrical connector assembly as claimed in claim 1, further comprising a cover enclosing a rear of the shielding shell and the substrate.

4. The electrical connector assembly as claimed in claim 3, wherein:
the cover includes a front part, a rear part, and an upper part;
the shielding shell extends through the front part; and
the latch is operable by the upper part.

5. The electrical connector assembly as claimed in claim 1, wherein the substrate includes a first slit receiving the latch arm and a second slit receiving the leg of the shielding shell.

6. The electrical connector assembly as claimed in claim 5, wherein the substrate includes a conductive pad on a rear surface thereof between the first slit and the second slit for soldering the latch arm and the leg of the shielding shell.

7. An electrical connector assembly comprising:
an connector including:
an insulative housing defining a receiving space forwardly communicating with an exterior in a front-to-back direction;
a metallic shell enclosing the housing;
a plurality of contacts retained in the housing;
said contacts mounted upon a printed circuit board extending in a vertical plane perpendicular to the front-to-back direction;
a pair of latches secured to two opposite end sections of the housing in a transverse direction perpendicular to the front-to-back direction, each of the latches including a latching arm deflectable in a vertical direction perpendicular to both the front-to-back direction and the transverse direction;
said printed circuit board forms a pair of slit units each including a first slit and a second slit spaced from each other in a transverse direction to respectively receive a rear end section of the latch and a rear end section of the shell; wherein
at least one of the rear end section of the shell and the rear end section of the latch is secured to the printed circuit board in the corresponding slit unit.

8. The electrical connector assembly as claimed in claim 7, wherein both said first slit and said second slit extend in the vertical direction with a dimension larger than a thickness of the housing in the vertical direction.

9. The electrical connector assembly as claimed in claim 7, wherein each of said latches further includes a mounting portion extending forwardly along the front-to-back direction into a corresponding receiving hole in the housing below the latching arm in the vertical direction, and a securing arm extending from the mounting portion downwardly in the vertical direction and secured within the first slit.

10. The electrical connector assembly as claimed in claim 9, wherein said securing arm is soldered with a corresponding conductive pad formed on a surface of the printed circuit board and neighboring the first slit.

11. An electrical connector assembly comprising:
a printed circuit board positioned in a vertical plane with opposite front and rear surfaces in a front-to-back direction, and defining at least a slit extending in a vertical direction perpendicular to said front-to-back direction with a distance from an upper edge thereof and through said printed circuit board in said front-to-back direction;
an electrical connector including an insulative housing with a mating cavity forwardly communicating with an exterior in the front-to-back direction, a plurality of contacts disposed in the housing and mounted upon said front surface;
a pair of latches located on two opposite end regions of the housing in the transverse direction perpendicular to both said vertical direction and said front-to-back direction, each of said latches including a latching arm extending forwardly along the front-to-back direction and deflectable in the vertical direction with a hook at a free end extending above a top wall of the housing, a pressing portion unitarily formed on an upper edge of the latching arm above the top wall of the housing, a mounting portion extending forwardly along the front-to-back direction below the latching arm in the vertical direction, and a securing arm extending downwardly in the vertical direction below the mounting portion and received within the slit.

12. The electrical connector assembly as claimed in claim 11, wherein said securing arm is dimensioned in the vertical direction to be similar to the pressing portion.

13. The electrical connector assembly as claimed in claim 11, wherein said securing arm is immoveable within the slit.

14. The electrical connector assembly as claimed in claim 13, wherein said securing arm is soldered with a corresponding conductive pad formed on either the front surface or the rear surface of the printed circuit board neighboring said slit.

15. An electrical connector assembly comprising:

a connector housing receiving a plurality of contacts mounted to an internal substrate;

a shielding shell enclosing the connector housing;

a pair of latches secured to the connector housing in a cantilevered fashion; and a cover enclosing a rear of the shielding shell and the substrate; wherein the latch has an arm secured to the substrate; and the cover includes a front part, a rear part, and an upper part, the shielding shell extends through the front part, and the latch is operable by the upper part.

16. The electrical connector assembly as claimed in claim 15, wherein the latch has a mounting portion located forwardly of the latch arm and secured to the connector housing.

17. The electrical connector assembly as claimed in claim 15, further comprising a cover enclosing a rear of the shielding shell and the substrate.

18. The electrical connector assembly as claimed in claim 15, wherein the shielding shell includes a leg, and the substrate includes a first slit receiving the latch arm and a second slit receiving the leg of the shielding shell.

19. The electrical connector assembly as claimed in claim 18, wherein the substrate includes a conductive pad on a rear surface thereof between the first slit and the second slit for soldering the latch arm and the leg of the shielding shell.

* * * * *